US007247235B2

(12) United States Patent
Virdi et al.

(10) Patent No.: US 7,247,235 B2
(45) Date of Patent: Jul. 24, 2007

(54) HYDROGENATION OF MIDDLE DISTILLATE USING A COUNTER-CURRENT REACTOR

(75) Inventors: Harjeet Virdi, Sugarland, TX (US); Arup Roy, Katy, TX (US); Thu-Huong Nguyen, Pearland, TX (US)

(73) Assignee: ABB Lummus Global Inc,, Bloomfield, NJ (US)

( * ) Notice: Subject to any disclaimer, the term of this patent is extended or adjusted under 35 U.S.C. 154(b) by 222 days.

(21) Appl. No.: 10/449,046

(22) Filed: May 30, 2003

(65) Prior Publication Data

US 2004/0238409 A1 Dec. 2, 2004

(51) Int. Cl.
*C10G 45/02* (2006.01)

(52) U.S. Cl. ..... 208/213; 208/212; 208/210; 208/217; 208/254 H; 208/412; 208/413

(58) Field of Classification Search ..... 208/412, 208/413, 210, 212, 213, 217, 254 R
See application file for complete search history.

(56) References Cited

U.S. PATENT DOCUMENTS 3,761,399 A * 9/1973 Kinney et al. ..... 208/210
3,767,562 A 10/1973 Sze et al.
3,846,278 A 11/1974 Sze et al.
4,021,330 A 5/1977 Satchell, Jr.
4,530,753 A 7/1985 Shiroto et al.
4,530,754 A 7/1985 Shiroto et al.
4,576,709 A 3/1986 Miller et al.
5,183,556 A 2/1993 Reilly et al.
5,522,983 A 6/1996 Cash et al.
5,643,442 A 7/1997 Sweet et al.
5,730,860 A 3/1998 Irvine
5,942,197 A 8/1999 Gupta et al.
6,153,086 A 11/2000 Gupta et al.
6,241,876 B1 6/2001 Tsao et al.
6,312,586 B1 11/2001 Klanes et al.
6,402,940 B1 6/2002 Rappas (Continued)

FOREIGN PATENT DOCUMENTS

WO WO 00/34416 6/2000

OTHER PUBLICATIONS

"Notification of Transmittal of the International Search Report and Written Opinion of the International Searching Authority", International Searching Authority, European Patent Office, mailed Dec. 2, 2004 in PCT/US2004/016910 filed May 28, 2004.

*Primary Examiner*—Tam M. Nguyen
(74) *Attorney, Agent, or Firm*—Dilworth & Barrese, LLP

(57) ABSTRACT

A process for the hydrogenation of a hydrocarbon feed includes contacting a major amount of the hydrocarbon feed with hydrogen in a counter-current manner in a first reaction zone under hydrogenation reaction conditions in the presence of a hydrogenation catalyst in at least a first catalyst bed wherein a liquid effluent exits at a bottom end of the first reaction zone and a hydrogen-containing gaseous effluent exits at a top end of the first reaction zone, and contacting a minor portion of the hydrocarbon feed with said hydrogen-containing gaseous effluent in a co-current manner in a second reaction zone having a catalyst bed positioned to receive the hydrogen-containing effluent of the first reaction zone.

21 Claims, 7 Drawing Sheets

U.S. PATENT DOCUMENTS 6,406,616 B1 6/2002 Rappas et al.
6,444,116 B1 9/2002 Galiasso et al.
6,444,118 B1 * 9/2002 Podrebarac et al. ..... 208/210
6,495,029 B1 12/2002 Schorfheide et al.
6,623,621 B1 9/2003 Iaccino et al.
6,623,622 B2 9/2003 Gupta
6,623,628 B1 9/2003 Bronner et al.
2001/0001450 A1 5/2001 Markley et al.
2002/0050466 A1 5/2002 Shih et al.

* cited by examiner

HYDROGENATION OF MIDDLE DISTILLATE USING A COUNTER-CURRENT REACTOR

BACKGROUND

1. Technical Field

The present disclosure relates to a process for hydrogenation of a middle distillate feedstock such as diesel fuel to produce improved quality diesel product.

2. Background of the Art

Petroleum distillates including gas oils boiling in the range of from about 330° F. to about 800° F., including straight run gas oils, visbreaker thermally cracked gas oil, coker gas oil, and FCC light cycle gas oil, are treated to produce improved quality diesel fuels. The diesel fuel must meet certain specifications relative to sulfur, nitrogen, olefins and aromatics content, cetane index, boiling point (distillation) and gravity. More stringent regulations will require refiners to produce ultra low sulfur content diesel (ULSD) in the coming years. Generally, this will force refiners to produce 10-50 wppm or lower sulfur content diesel fuel.

Desulfurization of hydrocarbon feedstocks by hydrotreating is known, i.e., by reacting the feedstock with hydrogen under appropriate conditions to remove the sulfur in the form of hydrogen sulfide ($H_2S$). With recent catalyst advancements, refiners can reduce the sulfur in the treated distillate product in the existing unit, but not enough to meet the pending regulations.

Many existing hydrotreaters which are currently producing diesel fuel with sulfur levels greater than 50 wppm will require revamping and/or implementation of new units. To achieve the required diesel fuel specifications, it is necessary to treat the distillate feedstock in order to affect the chemical and physical properties of the distillates. The catalyst type and operating severity are a function of the desired diesel fuel specifications. The processing requires hydrogenation with an appropriate catalyst or a combination of different catalyst systems over a hydrogen rich environment. For sulfur, nitrogen, olefins and aromatics reduction, deep hydrogenation is required. For cetane and/or gravity improvement, both deep hydrogenation and selective ring opening is required.

Prior practice conventional processing schemes to revamp existing hydrotreaters to produce ultra low sulfur diesel will typically add a new co-current reactor in series or parallel with the existing reactor to implement additional catalyst volume. In addition, this type of revamp scheme poses significant modifications and/or replacement of existing equipment items in the high pressure reaction loop including, major piping/heat exchanger, amine scrubber, and recycle compressor. All of these existing unit modifications will result in major capital investment and down time.

SUMMARY OF THE INVENTION

A process is provided herein for the hydrogenation of a hydrocarbon feed. The process comprises contacting a major portion of the hydrocarbon feed with hydrogen in a counter-current manner in a first reaction zone under hydrogenation reaction conditions in the presence of a hydrogenation catalyst in at least a first catalyst bed wherein a liquid effluent exits at a bottom end of the first reaction zone and a hydrogen-containing gaseous effluent exits at a top end of the first reaction zone; and contacting a minor portion of the hydrocarbon feed with said hydrogen-containing gaseous effluent in a co-current manner in a second reaction zone having a catalyst bed positioned to receive said hydrogen-containing effluent of the first reaction zone.

In another embodiment the process comprises (a) co-current contacting of the petroleum fraction with hydrogen in a first reaction zone in the presence of a first hydrogenation catalyst to produce a first effluent having a reduced heteroatom content; and, (b) contacting the first effluent with hydrogen in a counter-current manner in a second reaction zone in the presence of a second hydrogenation catalyst to produce a product having a heteroatom content of no more than about 50 ppm by weight.

The process entails deep hydrogenation and achieves ultra low sulfur content diesel fuel for both new and existing facilities without major modifications typically associated with conventional processing schemes.

BRIEF DESCRIPTION OF THE DRAWINGS

Various embodiments are described herein with reference to the drawings wherein.

DETAILED DESCRIPTION OF PREFERRED EMBODIMENT(S)

The present invention can be used for hydrogenation of a petroleum fraction, particularly a middle distillate such as that to be used for diesel fuel. Hydrogenation can be employed for hydrotreatment, for example, to remove heteroatoms or for dearomatization (e.g., hydrodesulfurization, hydrodenitrogenation, hydrodearomatization).

The processing scheme of the present invention employs a counter-current reactor which can be integrated into an existing hydrotreatment system. The counter-current reactor is implemented "outside the high pressure reaction loop" thus offering additional processing advantages, including lower installed cost, simpler revamp, no major piping/heat integration, no impact to the existing scrubber or the recycle gas compressor and reduced down time. The alternate scheme utilizes low cost base metal catalyst and offers improved product properties including aromatics reduction, cetane improvement and catalyst stability.

For revamps, the existing reactor operation is optimized so as to prepare feed to the new counter-current reactor. The counter-current reactor further treats the effluent from the existing reactor to achieve the required processing objectives.

Figure 1:
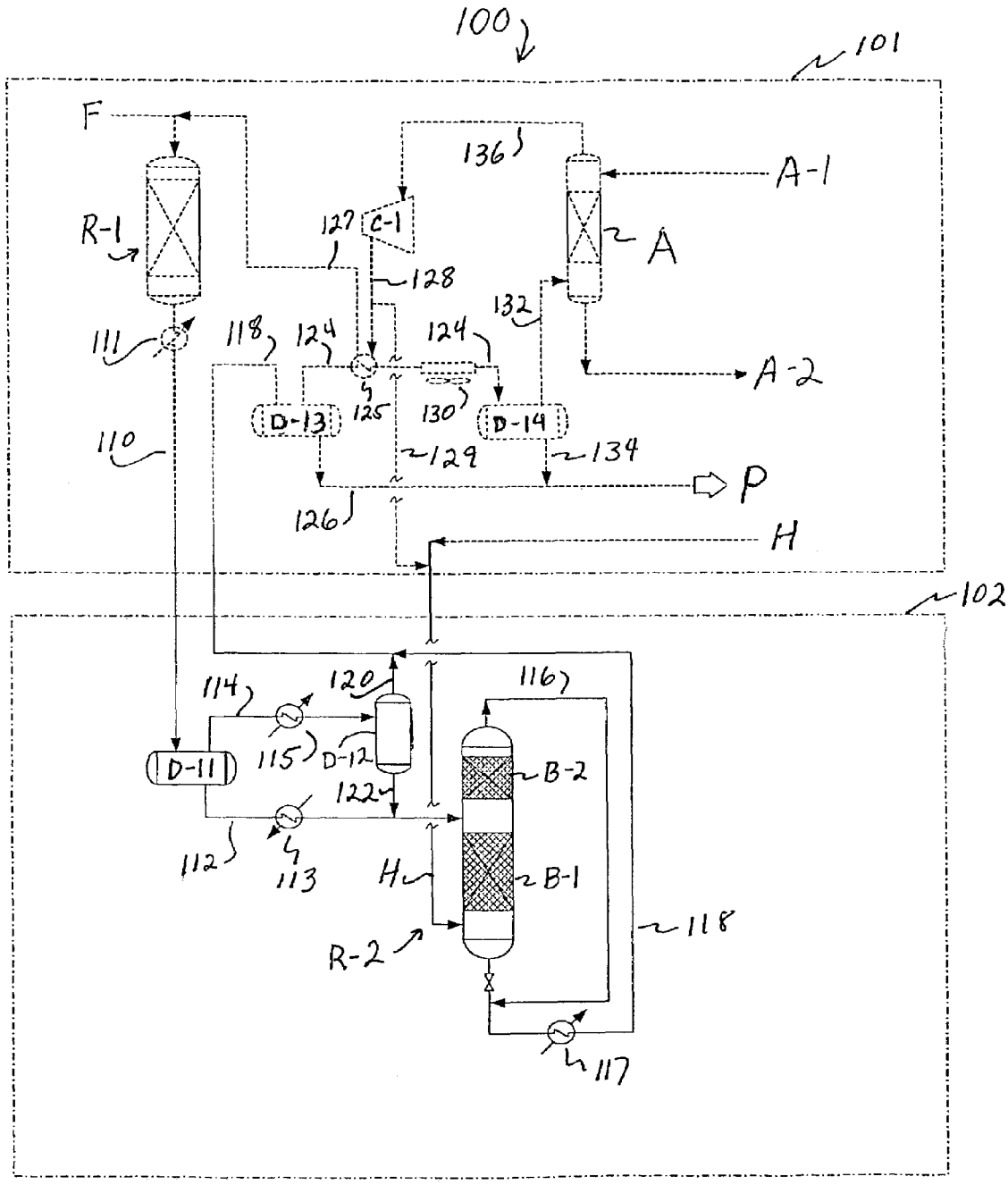
FIG. 1 is a schematic diagram of the process of the invention using a co-current reactor in conjunction with a new counter-current reactor of the invention.

Referring now to FIG. 1, a system 100 is shown for the hydrodesulfurization of a middle distillate. System 100 illustrates the revamping of a hydrotreating scheme outlined by 101 by the incorporation of counter-current reaction scheme 102. In the subsequent description of the remaining figures, like numerical or letter designations indicate like processing equipment or streams.

Feed F is a middle range petroleum fraction typically having the following properties as shown in Table 1:

TABLE 1

| API Gravity | 20–45 |
|---|---|
| | Distillation Range ° C. (° F.) |
| Initial boiling point | 165–260 (330–500) |
| End boiling point | 280–440 (536–825) |
| Sulfur, wt % | 0.01–2.0 |
| Nitrogen, (total) wppm | 15–1000 |
| Bromine Number, g/100 g | 1–10 |
| Cetane Index | 25–55 |

These ranges are given for the purpose of illustration. Feeds having properties outside of these ranges can also be used when appropriate.

Hydrogen is added to the feed F via line 127, and the mixed feed plus hydrogen is sent to co-current reactor R-1 wherein at least partial hydrodesulfurization is accomplished. Co-current reactor includes a bed containing a suitable hydrodesulfurization catalyst such as nickel (Ni), cobalt (Co), molybdenum (Mo), tungsten (W), and combinations thereof (such as Ni—Mo, Co—Mo, Ni—W, Co—Mo—Ni, Co—Mo—W), on a support such as silica, alumina, or silica-alumina. Co-current hydrodesulfurization reaction conditions typically include a temperature of from about 200° C. to about 450° C., a pressure of from about 300 psig to about 1,500 psig, and a space velocity of up to about 20 v/v/hr. The effluent 110 from reactor R-1 typically has a sulfur content of from about 100 ppm to about 1,000 ppm by weight. The at least partially desulfurized effluent (line 110) is cooled by heat exchanger 111 to a temperature of from about 200° C. to about 380° C. and sent to drum D-11 via line 110 where it is separated into a vapor and a liquid. The liquid is drawn off via line 112 and heated in heat exchanger 113 to a temperature of from about 225° C. to about 370° C. and then sent to countercurrent reactor R-2. The vapor from drum D-11 is further cooled by heat exchanger 115 and sent via line 114 to drum D-12 for further separation of vapor and liquid components. The vapor, containing hydrogen, hydrogen sulfide, and light hydrocarbon components, is added via line 120 to line 118 for transfer to drum D-13. The liquid is drawn off and sent via line 122 to stream 112 to be sent to reactor R-2.

Counter-current reactor R-2 preferably includes two or more beds of catalyst, B-1 and B-2. Reactor R-2 includes two reaction zones: a first zone in which counter-current contacting of hydrocarbon and hydrogen takes place, and a second reaction zone wherein co-current contacting of hydrocarbon and hydrogen takes place. As shown in FIG. 1, bed B-1 is in the first reaction zone and bed B-2 is in the second reaction zone. The hydrocarbon feed is introduced into reactor R-2 at a position between the first and second reaction zones. Each bed contains a hydrodesulfurization catalyst. Useful hydrodesulfurization catalysts include those such as mentioned above (e.g., Ni—Mo, Co—Mo, Ni—W on silica, alumina or silica-alumina support), as well as zeolites, noble metal catalysts, and the like. The liquid feed from line 112 is introduced into reactor R-2 between beds B-1 and B-2. Make-up hydrogen H is introduced at the bottom of the reactor R-2. Reactor R-2 operates at a temperature of from about 225° C. to about 450° C., a pressure of from about 250 psig to about 1,500 psig, and a space velocity of from about 0.6 to about 5.0 LHSV.

A major portion of the hydrocarbon feed to the reactor flows downward into the first reaction zone occupied by bed B-1. The hydrogen entering at the bottom of reactor R-2 travels upward in a counter-current manner against the downflow of liquid through the catalyst bed B-1. However, the hydrogen-containing gas exiting as an effluent from bed B-1 at the top of the first reaction zone entrains a minor portion of the hydrocarbon feed to the reactor. Any entrained hydrocarbon mist or vapor is reacted with the hydrogen-containing gas in the presence of the catalyst in bed B-2. Since both the hydrocarbon portion and the hydrogen-containing gas flow upward through bed B-1, the contacting is conducted in a co-current manner. The positioning of a catalyst bed B-2 above the feed inlet so as to receive the effluent hydrogen-containing gas from the first reaction zone insures that no hydrocarbon passes through reactor R-2 without contacting hydrogen in the presence of a catalyst, thereby achieving the requirements of ultra low sulfur content. The overhead 116 from reactor R-2 is combined with the bottom liquid, and the total effluent of reactor R-2 is cooled in heat exchanger 117 and sent via line 118 to drum D-13.

Liquid product P is separated and drawn off from drum D-13 via line 126, and the vapor is removed via line 124. The process and equipment described herein will provide a product P, useful as a diesel fuel component, having have a sulfur content of below 50 ppm by weight.

The vapor overhead from drum D-13 (containing hydrogen, hydrogen sulfide and some hydrocarbon components) is drawn off via line 124 and sent through heat exchanger 125 for cooling and then through air cooling unit 130 and into drum D-14 for further separation of liquid and vapor. The liquid from drum D-14 is drawn off the bottom through line 134 and added to stream 126 to form the product stream P of ultra low sulfur content petroleum fraction. The vapor from drum D-14 (containing hydrogen, hydrogen sulfide, and some light hydrocarbons such as methane ethane, etc.) is sent via line 132 to the bottom the absorber A wherein the upflow of vapor is contacted in a counter-current fashion with a downflowing absorbent to remove the hydrogen sulfide from the vapor stream. More particularly, a lean amine absorbent A-1 is introduced at the top of absorber 150. The amine absorbent is preferably, for example, an aqueous solution of an alkanolamine such as ethanolamine, diethanolamine, diisopropanolamine, methyldiethanolamine, triethanolamine, and the like.

The overhead hydrogen rich vapor (including some light hydrocarbon components) from the absorber A is sent via line 136 to a compressor C-1 where it is compressed to a pressure of from about 400 psig to about 1,600 psig. The stream 128 exiting the compressor C-1 can be divided into stream 129 which is mixed with make-up hydrogen stream H for transfer to reactor R-2, and stream 127 which is sent through unit 125 for heat exchange with stream 124 to feed stream F.

Figure 2:
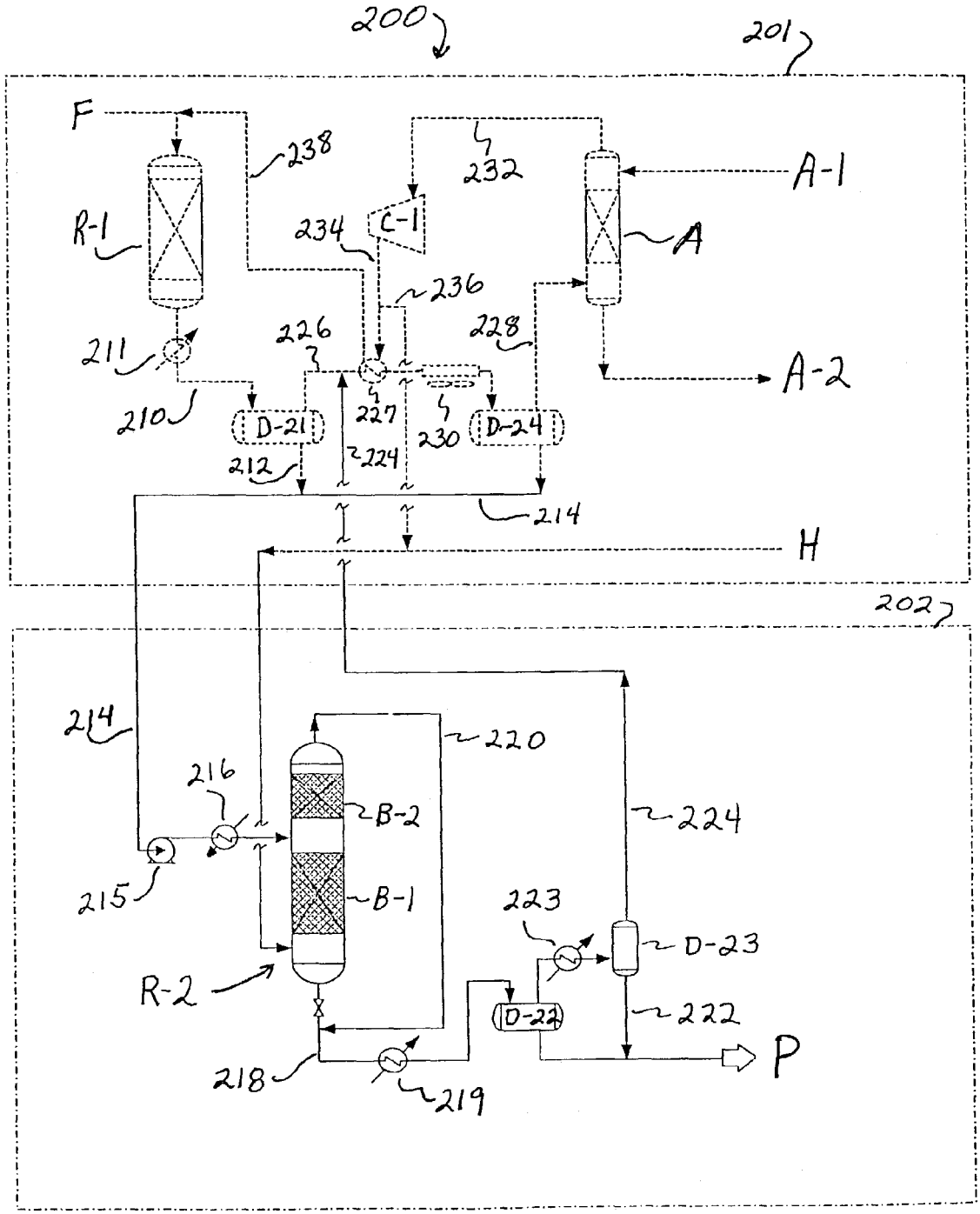
FIGS. 2-4 are schematic diagrams of other process schemes of the invention employing both co-current and new counter-current reactors.

Referring now to FIG. 2, system 200 illustrates the revamping of a hydrotreating scheme outlined by 201 by the incorporation of counter-current reaction scheme 202. Feed F, having a composition such as set forth above, is combined with hydrogen (and light hydrocarbons) from stream 238, and then sent to reactor R-1 where at least partial hydrodesulfurization is effected under the reaction conditions set forth above. The effluent 210 from reactor R-1 is cooled in heat exchanger 211 and sent to drum D-21 where liquid and vapor are separated. Vapor stream 226 from drum D-21 is sent through heat exchanger 227 and air cooler 230 and then to drum D-24. The liquid bottom from drum D-21 is drawn off in stream 212 and added to stream 214 from drum D-24, which is then sent to reactor R-2 through an optional pump 215 and heat exchanger 216. Exchanger 216 controls the temperature of stream 214 to a temperature of from about 200° C. to about 450° C. As described above, the feed to reactor R-2 is introduced between catalyst beds B-1 and B-2. The liquid flows down through bed B-1 against an upflow of hydrogen. The make-up hydrogen from hydrogen source H is introduced below bed B-1 and flows upward. Upward flowing entrained hydrocarbon mist is further treated in bed B-2. The overhead vapor containing hydrogen, hydrogen sulfide and hydrocarbon vapor is combined with the bottom liquid from reactor R-2 to form stream 218. The total effluent 218 from reactor R-2 is cooled in heat exchanger 219 and sent to settling drum D-22. The liquid from drum D-22 is drawn off as a product stream P. The vapor from drum D-22 is further cooled in heat exchanger 223 and sent to drum D-23 for further separation. The bottoms from drum D-23 are sent via stream 222 to the product stream P of ultra low sulfur content petroleum fraction. The overhead vapor stream 224 is added to vapor stream 226 from drum D-21. As mentioned above, stream 226 is cooled in heat exchanger 227, then cooled in air cooler 230 and sent to drum D-24. The bottom liquid from drum D-24 is sent to reactor R-2 via line 214. The overhead vapor from drum D-24 containing hydrogen, hydrogen sulfide and light hydrocarbons is sent into absorber A where it is counter-current contacted with a stream of downflowing amine $H_2S$ absorbent such as described above. The overhead $H_2S$-free vapor stream 232 containing mostly hydrogen with some light hydrocarbons is sent to compressor C-1 for compression to about 400 psig to about 1,600 psig. The compressor output stream 234 can be divided into stream 236, which is added to make-up hydrogen stream H, and stream 238, which is heat exchanged against stream 226 in exchanger 227 and then added to feed stream F for introduction into reactor R-1.

Figure 3:
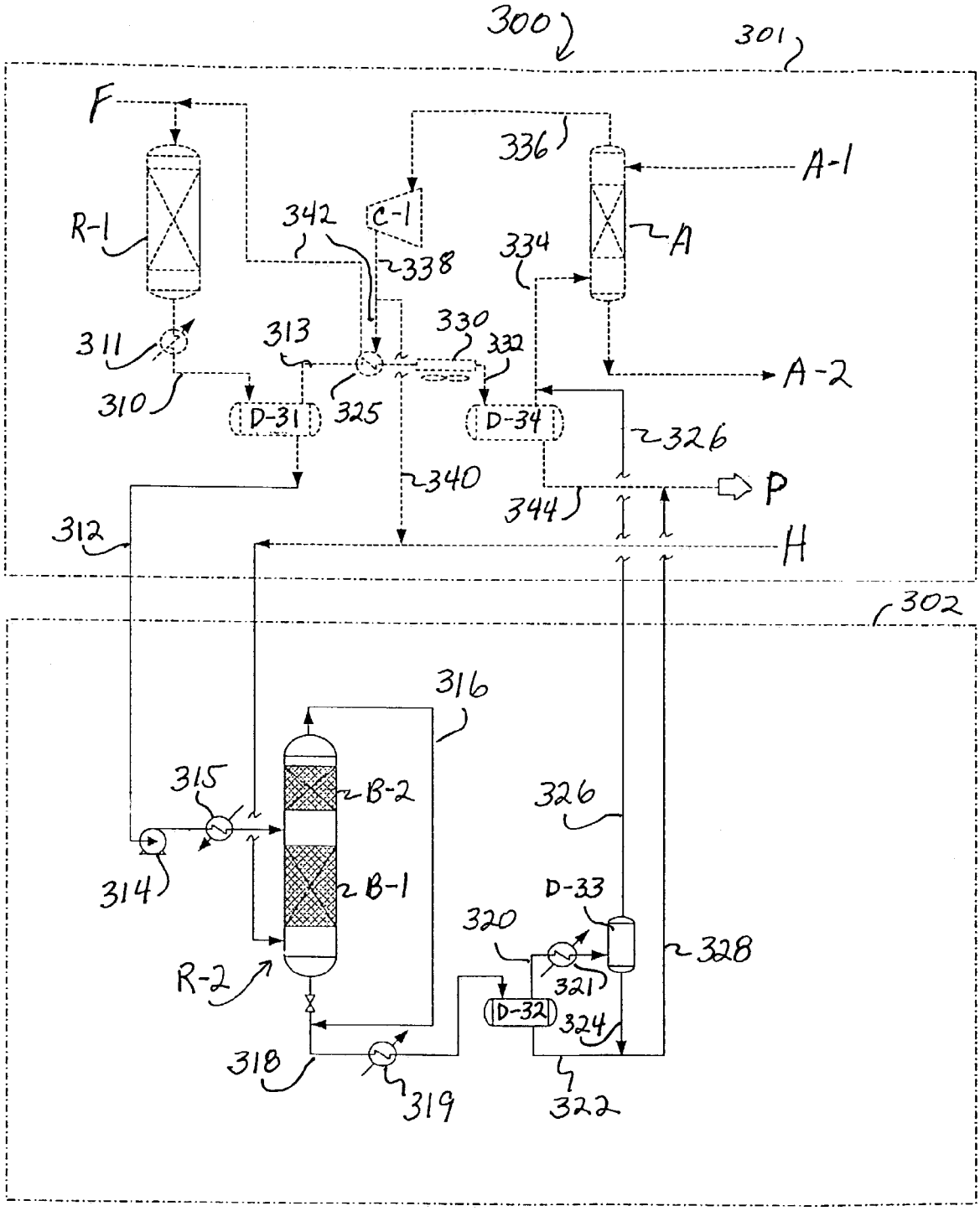

Referring now to FIG. 3, system 300 illustrates the revamping of a hydrotreating scheme outlined by 301 by the incorporation of counter-current reaction scheme 302. Feed F, having a composition as set forth above, is combined with stream 342 containing hydrogen and some light hydrocarbon components, and is introduced into reactor R-1 for at least partial hydrodesulfurization under the conditions stated above. The effluent 310 from reactor R-1 is cooled in heat exchanger 311 and sent to drum D-31 for separation of liquid and vapor. The liquid is sent via line 312 to reactor R-2 through an optional pump 314 and heat exchanger 315. Exchanger 315 controls the temperature of stream 312 to a temperature of from about 200° C. to about 450° C. As described above, the feed to reactor R-2 is introduced between catalyst beds B-1 and B-2. The liquid flows down through bed B-1 against an upflow of hydrogen. The make-up hydrogen from hydrogen source H is introduced below bed B-1 and flows upward. Upward flowing entrained hydrocarbon mist is further treated in bed B-2. The overhead vapor containing hydrogen, hydrogen sulfide and hydrocarbon vapor is combined with the bottom liquid from reactor R-2. The total effluent 318 from reactor R-2 is cooled in heat exchanger 319 and sent to settling drum D-32. The liquid from drum D-32 is drawn off via stream 322 to which is added the liquid bottoms from drum D-33 to form stream 328. Stream 328 is added to stream 344 from drum D-34 to form a product stream P. The vapor stream 320 from drum D-32 is further cooled in heat exchanger 321 and sent to drum D-33 for further separation. The bottoms from drum D-33 are sent via stream 324 to the stream 322, as mentioned above. The overhead vapor stream 326 from drum D-33 is added to the vapor stream 334 from drum D-34.

The vapor stream 313 from drum D-31 is cooled by heat exchange in heat exchanger 325 and further cooled by air cooler 330 before being sent to drum D-34 for separation of vapor and liquid. The liquid bottom stream 344 from drum D-34 is combined with liquid stream 328 from drum D-32 to form a product stream P of ultra low sulfur content petroleum fraction. The overhead vapor stream from drum D-34 is combined with vapor stream 326 from drum D-33 and sent via line 334 to absorber A wherein it is counter-current contacted with a stream of downflowing amine $H_2S$ absorbent such as described above. The overhead $H_2S$-free vapor stream 336 containing mostly hydrogen with some light hydrocarbons is sent to compressor C-1 for compression to about 400 psig to about 1,600 psig. The compressor output stream 338 can be divided into stream 340, which is added to make-up hydrogen stream H, and stream 342, which is heat exchanged against stream 313 in exchanger 325 and then added to feed stream F for introduction into reactor R-1.

Figure 4:
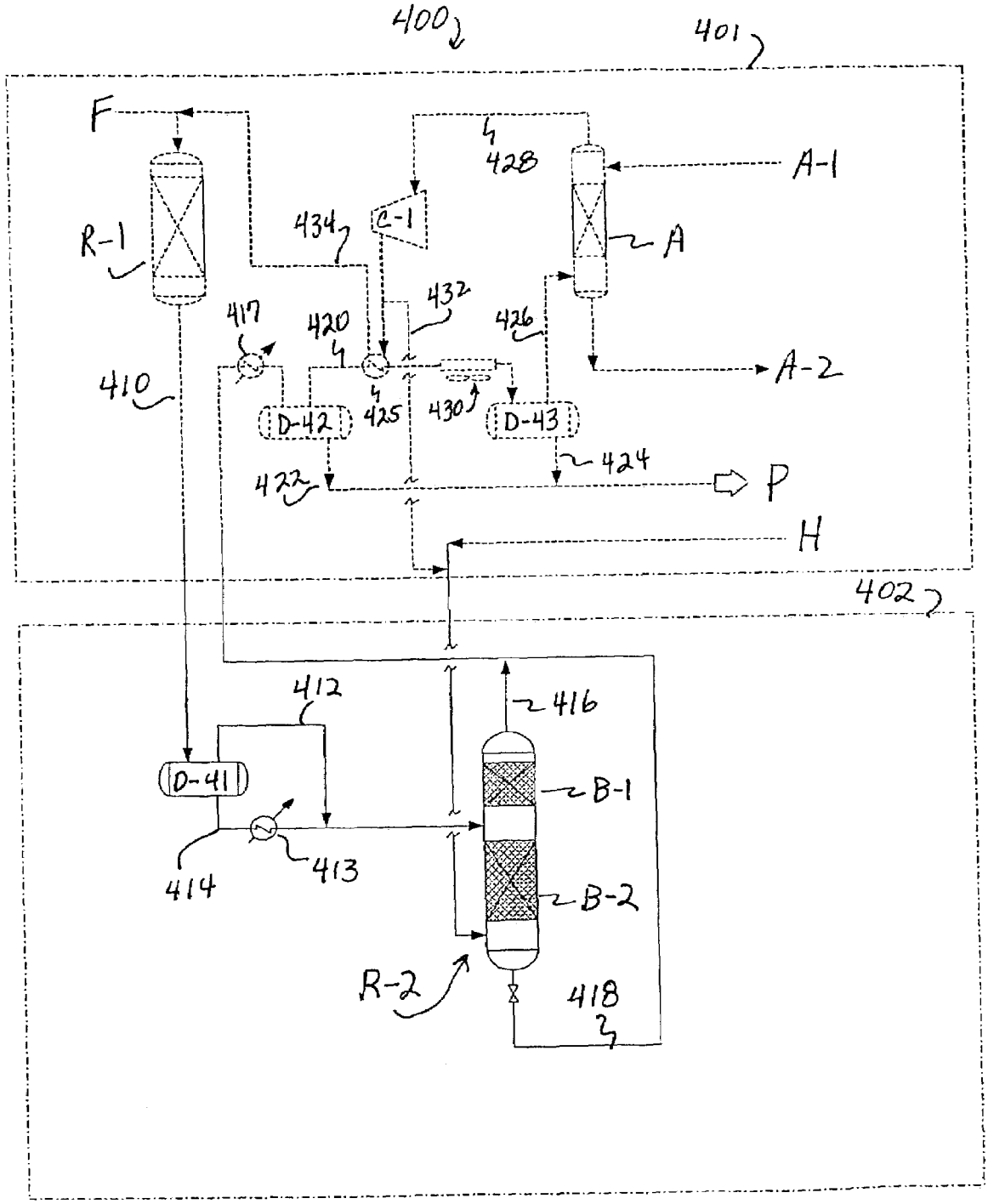

Referring now to FIG. 4, system 400 illustrates the revamping of a hydrotreating scheme outlined by 401 by the incorporation of counter-current reaction scheme 402. Feed F, having a composition as set forth above, is combined with stream 434 containing hydrogen and some light hydrocarbon components, and is introduced into reactor R-1 for at least partial hydro-desulfurization under the conditions stated above. The effluent 410 from reactor R-1 is sent to drum D-41. The liquid bottom stream 414 from drum D-41 is cooled by heat exchanger 413. The vapor overhead 412 is combined with the liquid stream 414, which is then sent to reactor R-2. As described above, the feed to reactor R-2 is introduced between catalyst beds B-1 and B-2. The liquid flows down through bed B-1 against an upflow of hydrogen. The make-up hydrogen from hydrogen source H is introduced below bed B-1 and flows upward. Upward flowing entrained hydrocarbon mist is further treated in bed B-2. The bottom effluent stream 418 from reactor R-2 is sent via line 418 through cooler 417 into drum D-42. The overhead vapor 416 from reactor R-2 is added to stream 418 prior to cooling in cooler 417. The liquid bottoms from drum D-42 is sent via stream 422 to become a product stream P. The overhead 420 from the drum D-42 is cooled by heat exchange in heat exchanger 425 and further cooled by air cooler 430 before being sent to drum D-43 for separation of vapor and liquid. The liquid bottom stream 424 from drum D-43 is combined with liquid stream 422 from drum D-42 to form a product stream P of ultra low sulfur content petroleum fraction. The overhead vapor stream from drum D-43 is sent via line 426 to absorber A wherein it is counter-current contacted with a stream of downflowing amine $H_2S$ absorbent such as described above. The overhead $H_2S$-free vapor stream 428 containing mostly hydrogen with some light hydrocarbons is sent to compressor C-1 for compression to about 400 psig to about 1,600 psig. The compressor output stream is divided into stream 432, which is added to make-up hydrogen stream H, and stream 434, which is heat exchanged against stream 420 in exchanger 425 and then added to feed stream F for introduction into reactor R-1.

Figure 5:
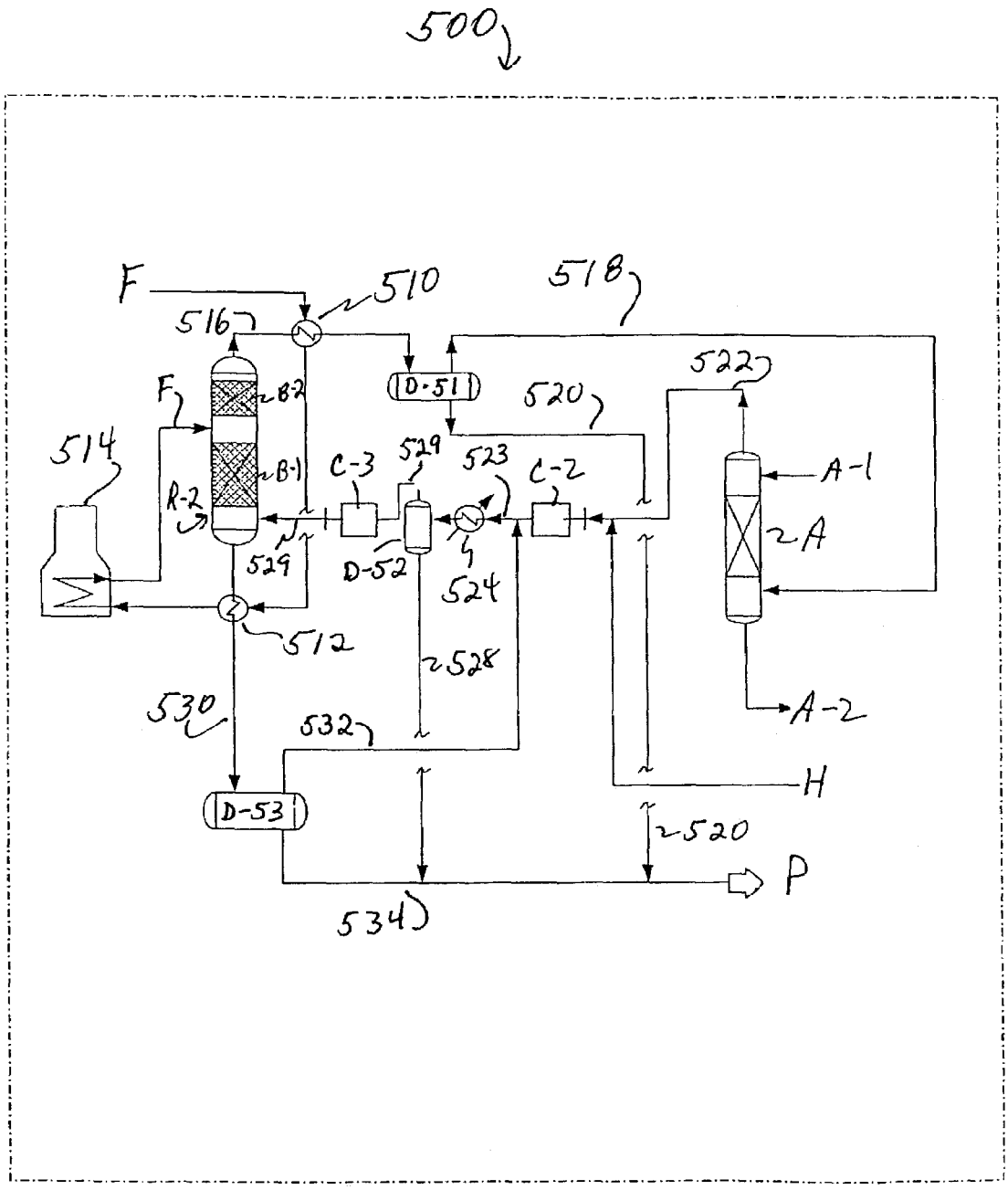
FIG. 5 is a schematic diagram of a process scheme for the hydrogenation of a petroleum distillate using only a counter-current reactor.

Referring now to FIG. 5, system 500 is shown wherein a co-current reactor R-1 is not employed to pretreat the feed by partial hydrotreating. Rather, only reactor R-2 is used for hydrogenation. Feed F is heated in heat exchanger 510 and then in heat exchanger 512, and then sent for further heating in heater 514 to a temperature of from about 200° C. to about 450° C. The heated feed is then introduced into reactor R-2 in between beds B-1 and B-2, as explained above. Hydrogen stream 529 is introduced at the bottom of reactor R-2 and flows upward against the downflow of liquid petroleum distillate. As stated above, entrained hydrocarbons carried by the upflow of gas enter bed B-2 and are subjected to hydrotreating so that no portion of the feed F exits the reactor R-2 without hydrotreatment. The overhead stream 516 from reactor R-2 is cooled in heat exchanger 510 by exchanging heat to the incoming feed F, and is then sent to drum D-51 for separation of liquid and vapor. The liquid bottoms from drum D-51 are sent via stream 520 to join stream 534, the liquid bottoms from drum D-53, so as to provide a product stream P. The overhead vapor stream 518 from drum D-51 containing hydrogen, hydrogen sulfide and some light hydrocarbons, is sent to absorber A wherein upflowing vapor is contacted against downflowing lean amine $H_2S$ absorbent A-1. The overhead $H_2S$-free vapor stream 522 from the absorber A, containing hydrogen and some light hydrocarbons, is combined with make-up hydrogen from hydrogen source H and sent to compressor C-2/C-3 for compression. The overhead stream 532 from drum D-53 is combined with the outflow of compressor C-2 to form stream 523, which is cooled in heat exchanger 524 and then sent to drum D-52 for further separation of liquid and vapor. The liquid bottoms from drum D-52 is sent via stream 528 to the bottom stream 534 from drum D-53 so as to provide the ultra low sulfur content product P. The overhead 529 from drum D-52 is sent to compressor C-3 for compression, and is then sent to the bottom of reactor R-2. The overall compression between C-2 and C-3 is about 300 psig to about 1,600 psig.

Figure 6:
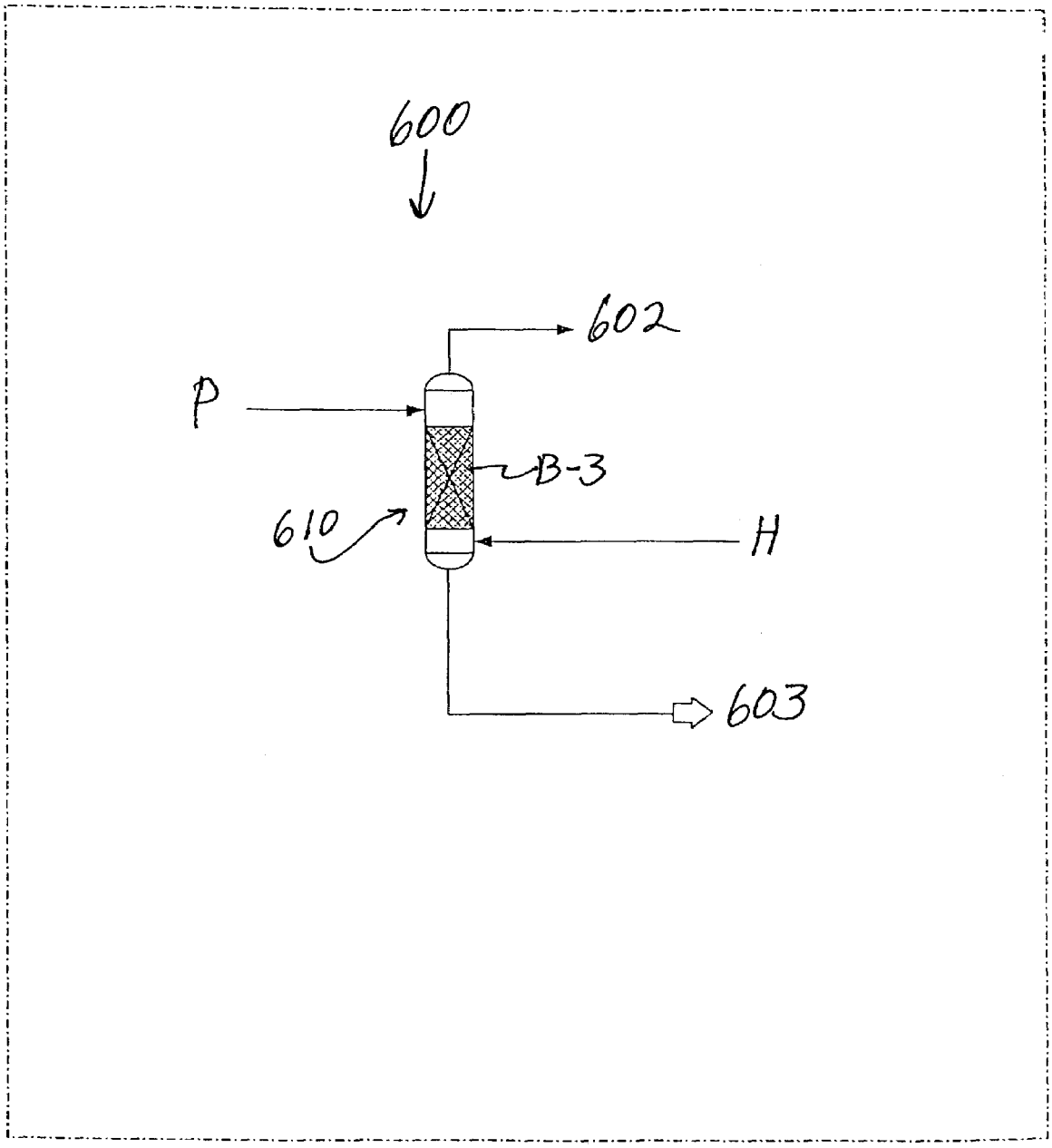
FIG. 6 is a diagram of a subsequent dearomatization treatment which can be performed on the product of the hydrogenation process of the invention; and, FIG. 7 is a diagrammatic illustration of a multi-bed countercurrent reactor of the invention.

Referring now to FIG. 6, the ultralow sulfur content product P can be further hydrogenated. For example, system 600 includes a reactor 610 for hydrodearomatization containing a bed B-3 of hydrogenation catalyst. The reactor is typically operated at a temperature of from about 200° C. to about 400° C., a pressure of from about 400 psig to about 1,600 psig and a space velocity of from about 0.3 to about 6 LHSV, preferably about 3.5 LHSV. Various hydrogenation processes are known and disclosed, for example, in U.S. Pat. No. 5,183,556, which is herein incorporated by reference. The catalyst in bed B-3 can be a noble metal or non-noble metal catalyst supported silica, alumina, silica-alumina, zirconia, or other metal oxide. Hydrogen from hydrogen source H is introduced into the bottom of reactor 610 and flows upward against the downflow of petroleum distillate fraction. The overhead vapor is removed via stream 602, and the bottom effluent containing dearomatized petroleum distillate is removed via stream 603.

Figure 7:
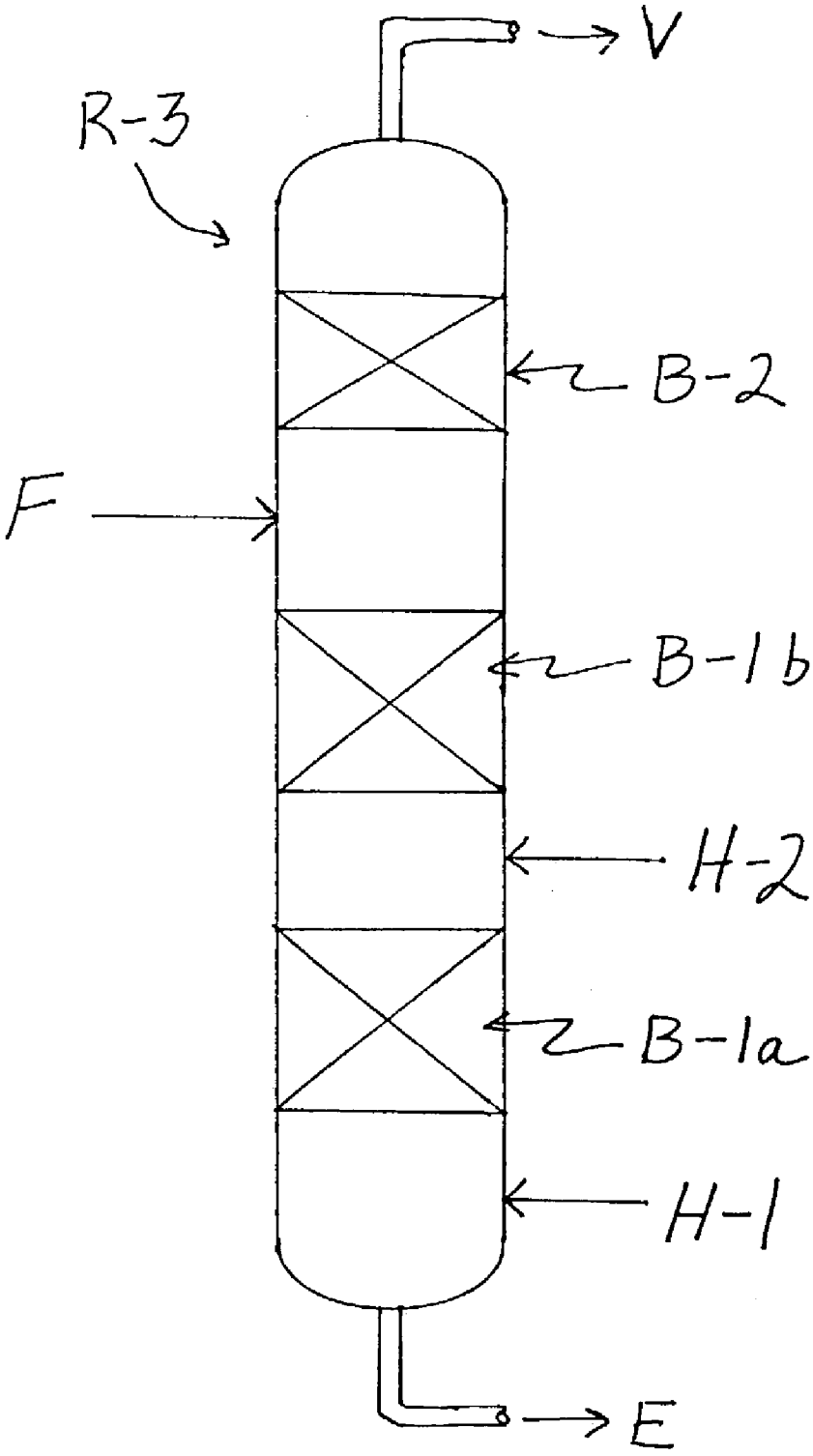

Referring now to FIG. 7, an alternative multi-bed, countercurrent hydrogenation reactor R-3 is illustrated. Reactor R-3 contains three spaced-apart catalyst beds, B-1*a*, B-1*b* and B-2. The feed F is introduced between the middle bed B-1*b* and the uppermost bed B-2. Hydrogen is introduced via lines H-1 and H-2. The H-1 input to the reactor R-3 is positioned beneath the lowest bed B-1*a*, and the H-2 input to the reactor R-3 is positioned above bed B-1*a* and below bed B-1*b*. Hydrogen flows upward against the downflow of petroleum distillate feed F, and hydrogenation of feed F (e.g., hydrodesulfurization, hydrodenitrogenation) is effected in beds B-1*a* and B-1*b* by counter-current contacting with hydrogen. As mentioned above, some hydrocarbon components can be entrained in the upward flow of hydrogen, and these components are hydrogenated in bed B-2 so that all of the feed is subjected to hydrogenation. The overhead vapor stream V contains excess hydrogen, hydrogen sulfide and some light hydrocarbon components. The liquid effluent E taken from the bottom of the reactor contains ultra low sulfur content petroleum distillate (e.g., diesel fuel).

The Example below illustrates aspects of the invention.

EXAMPLE

A feedstock was provided having the following range of properties:

| API Gravity | 27–40 |
|---|---|
| | Distillation Range ° C. (° F.) |
| Initial boiling point | 165–260 (330–500) |
| End boiling point | 280–440 (536–825) |
| Sulfur, wt % | 0.01–0.05 |
| Nitrogen, (total) wppm | 5–100 |

The feedstock was treated in a hydrogenation system having a counter-current reactor in accordance with the invention. The reaction conditions included a temperature of 346° C., a pressure of 750 psig, a space velocity of 1.6 LHSV, and a hydrogenation catalyst comprising NiMo on a silica support. The resulting product had an API Gravity of 38.6, a sulfur content of 8 ppm by weight, and a nitrogen content of less than 1 ppm by weight.

While the above description contains many specifics, these specifics should not be construed as limitations on the scope of the invention, but merely as exemplifications of preferred embodiments thereof. For example, the first and second reaction zones can be situated in different reactor shells as well as a single reactor shell. Those skilled in the art will envision many other possible variations that are within the scope and spirit of the invention as defined by the claims appended hereto.

What is claimed is:

1. A process for the hydrogenation of a petroleum fraction which comprises:

a) co-current contacting the petroleum fraction in a first hydrotreating unit with a first hydrogen stream under hydrogenation reaction conditions to provide a partially treated first effluent containing a liquid component and a first vapor component;

b) cooling the first effluent in a first heat exchange step;

c) removing the first vapor component from the cooled first effluent in at least one liquid-vapor separation unit to provide a separation unit effluent containing substantially only liquid component;

d) heating the separation unit effluent in a second heat exchange step to provide a heated liquid component;

e) introducing the heated liquid component of step (d) into a second hydrotreating unit, wherein a major portion of the heated liquid component of step (d) is contacted with a second hydrogen stream in a counter-current manner in a first reaction zone under hydrogenation reaction conditions in the presence of a first hydrogenation catalyst in at least a first catalyst bed to provide a treated bottom effluent which exits the first reaction zone at a bottom end of the first reaction zone and a hydrogen-containing gaseous effluent which exits the first reaction zone at a top end of the first reaction zone, and wherein a minor portion of the heated liquid component of step (d) is contacted with the hydrogen-containing gaseous effluent in a co-current manner in a second reaction zone under hydrogenation reaction conditions in the presence of a second hydrogenation catalyst to provide a treated overhead effluent which exits the second reaction zone at a top end of the second reaction zone;

f) combining the entire treated overhead effluent with the treated bottom effluent to provide a combined treated effluent; and g) removing a second vapor component from the combined effluent of the second hydrotreating unit to provide a product stream.

2. The process of claim 1 wherein the second reaction zone of the second hydrotreating unit is positioned above and is spaced apart from the first reaction zone of the second hydrotreating unit.

3. The process of claim 2 wherein at least some hydrogen of the second hydrogen stream is introduced into the second hydrotreating unit at a portion beneath the first reaction zone.

4. The process of claim 2 wherein the first reaction zone of the second hydrotreating unit comprises at least one catalyst bed.

5. The process of claim 4 wherein the first reaction zone of the second hydrotreating unit comprises an upper first catalyst bed and a lower second catalyst bed positioned below and spaced apart from the first catalyst bed.

6. The process of claim 5 wherein at least some hydrogen of the second hydrogen stream is introduced into the second hydrotreating unit beneath the lower second catalyst bed and at least some hydrogen of the second hydrogen stream is introduced into the second hydrotreating unit between the upper first catalyst bed and lower second catalyst bed.

7. The process of claim 1 wherein the petroleum fraction contains an initial percentage composition of sulfur, the process for hydrogenation being hydrodesulfurization, and the product stream containing below about 50 ppm by weight of sulfur.

8. The process of claim 1 wherein the process is hydrodenitrogenation.

9. The process of claim 1 wherein the process is hydrodearomatization.

10. The process of claim 1 wherein the petroleum fraction is a middle distillate having an initial boiling point ranging from about 165° C to about 260° C. and an end boiling point ranging from about 280° C. to about 440° C.

11. The process of claim 1 wherein the hydrogenation reaction conditions include a temperature of from about 200° C. to about 450° C. a pressure of from about 300 psig to about 1,500 psig, and a space velocity of from about 0.4 to about 20 LHSV.

12. The process of claim 1 wherein the first hydrogenation catalyst includes one or more metals selected form the group consisting of cobalt, molybdenum, nickel and tungsten on a catalyst support.

13. The process of claim 12 wherein the catalyst support is an inorganic oxide selected from the group consisting of silica, alumina, silica-alumina, magnesia, zirconia and titania.

14. A process for hydrogenation of a petroleum fraction which comprises:

a) co-current contacting the petroleum fraction in a first hydrotreating unit with a first hydrogen stream under hydrogenation reaction conditions to provide a partially treated first effluent containing a liquid component and a first vapor component;

b) removing the first vapor component from the first effluent in at least one liquid-vapor separation unit to provide a separation unit liquid component containing substantially only liquid component;

c) cooling the separation unit liquid component and rejoining the first vapor component to the cooled separation unit liquid component to provide a combined liquid-vapor separation unit effluent;

d) introducing the separation unit effluent of step (c) into a second hydrotreating unit, wherein a major portion of the liquid component of step (c) is contacted with a second hydrogen stream in a counter-current manner in a first reaction zone under hydrogenation reaction conditions in the presence of a first hydrogenation catalyst in at least a first catalyst bed to provide a treated bottom effluent which exits the first reaction zone at a bottom end of the first reaction zone and a hydrogen-containing gaseous effluent which exits the first reaction zone at a top end of the first reaction zone, and wherein a minor portion of the liquid component of step (c) is contacted with the hydrogen-containing gaseous effluent in a co-current manner in a second reaction zone under hydrogenation reaction conditions in the presence of a second hydrogenation catalyst to provide a treated overhead effluent which exits the second reaction zone at a top end of the second reaction zone;

e) combining the entire treated overhead effluent with the treated bottom effluent to provide a combined treated effluent; and f) removing a second vapor component from the combined treated effluent of the second hydrotreating unit to provide a product stream.

15. The process of claim 14 wherein the second reaction zone of the second hydrotreating unit is positioned above and is spaced apart from the first reaction zone of the second hydrotreating unit.

16. The process of claim 15 wherein at least some hydrogen of the second hydrogen stream is introduced into the second hydrotreating unit at a portion beneath the first reaction zone.

17. The process of claim 15 wherein the first reaction zone of the second hydrotreating unit comprises at least one catalyst bed.

18. The process of claim 17 wherein the first reaction zone of the second hydrotreating unit comprises an upper first catalyst bed and a lower second catalyst bed positioned below and spaced apart from the upper first catalyst bed.

19. The process of claim 18 wherein at least some hydrogen of the second hydrogen stream is introduced into the second hydrotreating unit beneath the lower second catalyst bed and at least some hydrogen of the second hydrogen stream is introduced into the second hydrotreating unit between the upper first catalyst bed and lower second catalyst bed.

20. A process for the hydrogenation of a petroleum fraction comprising a) introducing the petroleum fraction into a hydrotreating unit wherein a major portion of the petroleum fraction is contacted with a stream of hydrogen in a counter-current manner in a first reaction zone under hydrogenation reaction conditions in the presence of a first hydrogenation catalyst in at least a first catalyst bed to provide a treated bottom effluent which exits the first reaction zone at a bottom end of the first reaction zone and a hydrogen-containing gaseous effluent which exits the first reaction zone at a top end of the first reaction zone, and wherein a minor portion of the petroleum fraction is contacted with the hydrogen-containing gaseous effluent in a co-current manner in a second reaction zone under hydrogenation reaction conditions in the presence of a second hydrogenation catalyst to provide a treated overhead effluent which exits the hydrotreating unit at a top end of the hydrotreating unit b) cooling the treated bottom effluent of the hydrotreating unit;

c) separating a first vapor component from the cooled treated bottom effluent to provide a treated product stream;

d) cooling the treated overhead effluent from the hydrotreating unit;

e) separating a second vapor component from the cooled treated overhead effluent to provide a liquid bottom which is combined with the product stream;

f) scrubbing the second vapor component to remove heteroatoms;

g) adding hydrogen to the scrubbed second vapor component;

h) compressing the scrubbed second vapor component in at least a two stage compression system with intermediate cooling and with intermediate separation of a liquid condensate to provide a compressed vapor stream;

i) combining the liquid condensate with the product stream; and j) introducing the compressed vapor stream into the hydrotreating unit.

21. A process for the hydrogenation of a petroleum fraction which comprises:

a) co-current contacting the petroleum fraction in a first hydrotreating unit with a first hydrogen stream under hydrogenation reaction conditions to provide a partially treated first effluent containing a liquid component and a first vapor component;

b) cooling the first effluent in a first heat exchange step;

c) removing the first vapor component from the cooled first effluent in at least one liquid-vapor separation unit to provide a separation unit effluent containing substantially only liquid component;

d) heating the separation unit effluent in a second heat exchange step to provide a heated liquid component;

e) introducing the heated liquid component of step (d) into a second hydrotreating unit, wherein a major portion of the heated liquid component of step (d) is contacted with a second hydrogen stream in a counter-current manner in a first reaction zone under hydrogenation reaction conditions in the presence of a first hydrogenation catalyst in at least a first catalyst bed to provide a treated bottom effluent which exits the first reaction zone at a bottom end of the first reaction zone and a hydrogen-containing gaseous effluent which exits the first reaction zone at a top end of the first reaction zone, and wherein a minor portion of the heated liquid component of step (d) is entrained and upwardly carried by the hydrogen-containing gaseous effluent and contacted with the hydrogen-containing gaseous effluent in a co-current manner in a second reaction zone under hydrogenation reaction conditions in the presence of a second hydrogenation catalyst to provide a treated overhead effluent which exits the second reaction zone at a top end of the second reaction zone;

f) combining the entire treated overhead effluent with the treated bottom effluent to provide a combined treated effluent; and g) removing a second vapor component from the combined effluent of the second hydrotreating unit to provide a product stream.

* * * * *